US006547095B1

(12) United States Patent
Emoff

(10) Patent No.: US 6,547,095 B1
(45) Date of Patent: Apr. 15, 2003

(54) COUPON DISPENSER AND COLLECTION DEVICE

(76) Inventor: Michael J. Emoff, 5450 Sherfield Dr., Trotwood, OH (US) 45426

( * ) Notice: Subject to any disclaimer, the term of this patent is extended or adjusted under 35 U.S.C. 154(b) by 103 days.

(21) Appl. No.: 09/818,137

(22) Filed: Mar. 27, 2001

Related U.S. Application Data

(60) Provisional application No. 60/192,217, filed on Mar. 27, 2000, and provisional application No. 60/203,738, filed on May 11, 2000.

(51) Int. Cl.[7] ..... A47K 10/24
(52) U.S. Cl. ..... 221/46; 206/812
(58) Field of Search ..... 221/33, 45, 63, 221/92, 123, 97, 131, 46; 206/445, 812

(56) References Cited

U.S. PATENT DOCUMENTS

| | | | | |
|---|---|---|---|---|
| 1,799,656 | A | 4/1931 | Tinsley | |
| 1,840,439 | A | 1/1932 | Ewell | |
| 2,080,038 | A | 5/1937 | Frederickson | |
| 2,451,382 | A | 10/1948 | Davis | |
| 2,681,156 | A | 6/1954 | Williams | |
| 3,089,586 | A | 5/1963 | Cole | |
| 3,331,533 | A | 7/1967 | Krugger | |
| 3,372,837 | A | 3/1968 | Neumann | |
| 4,011,943 | A | 3/1977 | Galli et al. | |
| 4,392,028 | A | 7/1983 | Saxton | |
| 4,671,455 | A | 6/1987 | Stockman | |
| 4,699,312 | A | 10/1987 | Owen | |
| 4,913,312 | A | 4/1990 | Boutin | |
| 4,919,302 | A | 4/1990 | McPherson | |
| 5,042,687 | A | 8/1991 | McKinley | |
| 5,054,612 | A | 10/1991 | Meyer, Jr. | |
| 5,181,651 | A | 1/1993 | Oppenheim | |
| 5,469,987 | A | 11/1995 | Honkawa | |
| 5,813,597 | A | 9/1998 | Wakevainen | |
| 2002/0092860 | A1 * | 7/2002 | Simpson | 221/58 |

* cited by examiner

*Primary Examiner*—Kenneth W. Noland
(74) *Attorney, Agent, or Firm*—Roger S. Dybvig

(57) ABSTRACT

A coupon dispensing and containing device for use as a sweepstake's box that includes an outer box having at least one coupon-dispensing opening and at least one inner box affixed within the outer box, each of the at least one inner boxes containing coupons and having a coupon-exit opening aligned with a coupon-dispensing opening in the outer box.

4 Claims, 1 Drawing Sheet

WIN!
22
10
12
20
14
14
WIN!
22
24
WIN!
22

22
20
12
14
16

14
26
WIN!
16
26
14
22
WIN!
16
20
12
24

COUPON DISPENSER AND COLLECTION DEVICE

CROSS-REFERENCE TO RELATED APPLICATION

This application claims the benefit of U.S. Provisional Applications No. 60/192,217, filed Mar. 27, 2000, and Ser. No. 60/203,738, filed May 11, 2000.

FIELD OF THE INVENTION

This invention relates to a coupon dispenser and collection device. The invention is particularly directed to a device known as a "sweepstake's box" which is typically placed on a checkout counter of a retail establishment and used to dispense and collect coupons connected with a sweepstake's or related advertising program.

INCORPORATION BY REFERENCE

The disclosures of U.S. Pat. No. 5,944,219, issued Aug. 31, 1999, to Emoff et al., and U.S. Pat. No. 5,979,699, issued Nov. 9, 1999, to Simpson, are hereby incorporated by reference herein.

BACKGROUND OF THE INVENTION

A sweepstake's box typically comprises a hollow, square box made from heavy cardboard or other relatively rigid sheet material which has a top wall with a centrally-located slot which opens to the interior of the box. A pad of tickets, coupons or fill-in slips, generically referred to herein as "coupons", which are to be filled in by the consumer is often mounted in a convenient location on the outside of the box so that a customer can easily remove a coupon from the pad, fill in the information as needed on the coupon to qualify as a sweepstake's entrant, and deposit the coupon in the sweepstake box by dropping it through the slot. Sweepstake's boxes may have other configurations of slots and coupon pads.

Sweepstake's boxes provided with pads of coupons have the drawback that one person can easily remove many coupons at the same time and either use or discard the coupons, with the result that many coupons may not be used.

The foregoing U.S. patents disclose pop-up coupon dispensers which have a coupon-filled. box having a slot through which coupons may be removed from the box. As the topmost coupon in a box is removed, the next topmost coupon in the box is partly pulled out of the box through the slot. The Emoff et al. '219 patent discloses a coupon dispenser which is easily attached to a wire rack, shelf or other location within a retail store, often a grocery store, to advertise products at that location in the store. Similar coupon dispensers which are not provided with means for attachment to a rack or shelf or the like are available from 3M Company of Saint Paul, Minn. Such dispensers are made from heavy paper or cardboard and are so inexpensive that they are considered to be disposable.

SUMMARY OF THE INVENTION

An object of this invention is to provide an improved coupon dispenser and collection device. More specifically, an object of this invention is to provide a sweepstake's box in which sweepstake's coupons to be filled in are housed within the sweepstake's box instead of exposed outside the box.

In accordance with this invention, a sweepstake's box is provided that comprises an outer box having a hollow interior chamber. The box serves as a collection bin for sweepstake's coupons which have been filled in and inserted into the box through a first slot in the box. In addition, the sweepstake's box has at least one and preferably two or more additional slots through which coupons are dispensed one-at-a-time. For ease of manufacture and assembly, one or more coupon dispensers, such as those shown in the Emoff et al. '219 patent and in the Simpson '699 patent, are mounted in the sweepstake's box and held therein in any suitable fashion so that the slots in the coupon dispensers are located in alignment with the dispensing opening or openings in the sweepstake's box.

Other objects and advantages will become apparent from the drawings and the following description.

DETAILED DESCRIPTION

Figure 1:
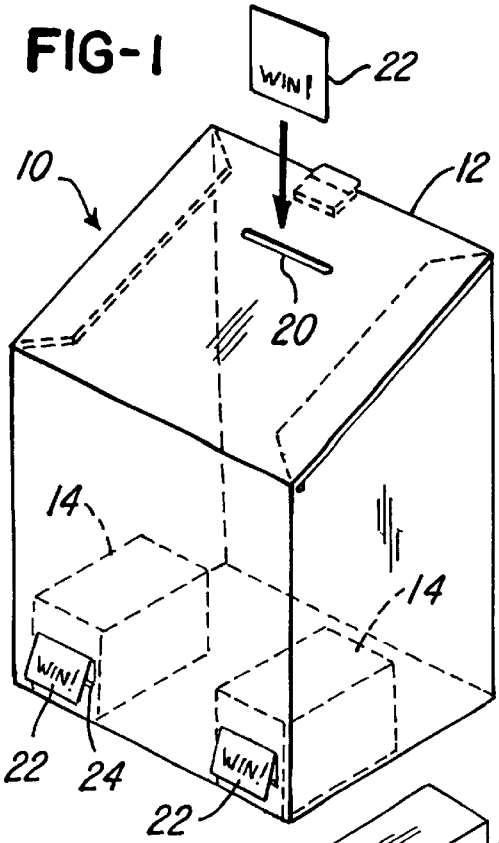
FIG. 1 is an isometric view of a sweepstake's box in accordance with this invention and diagrammatically illustrates a coupon being inserted through a slot in the top wall of the box.
Figure 2:
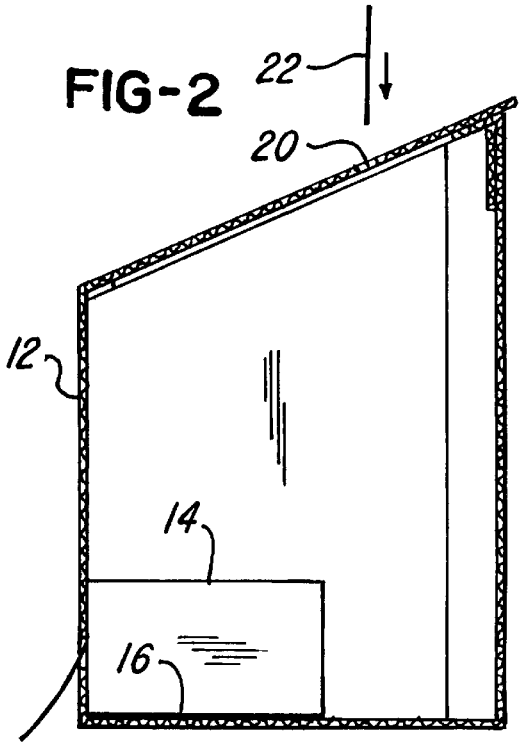
FIG. 2 is cross-sectional view of the box of FIG. 1.
Figure 3:
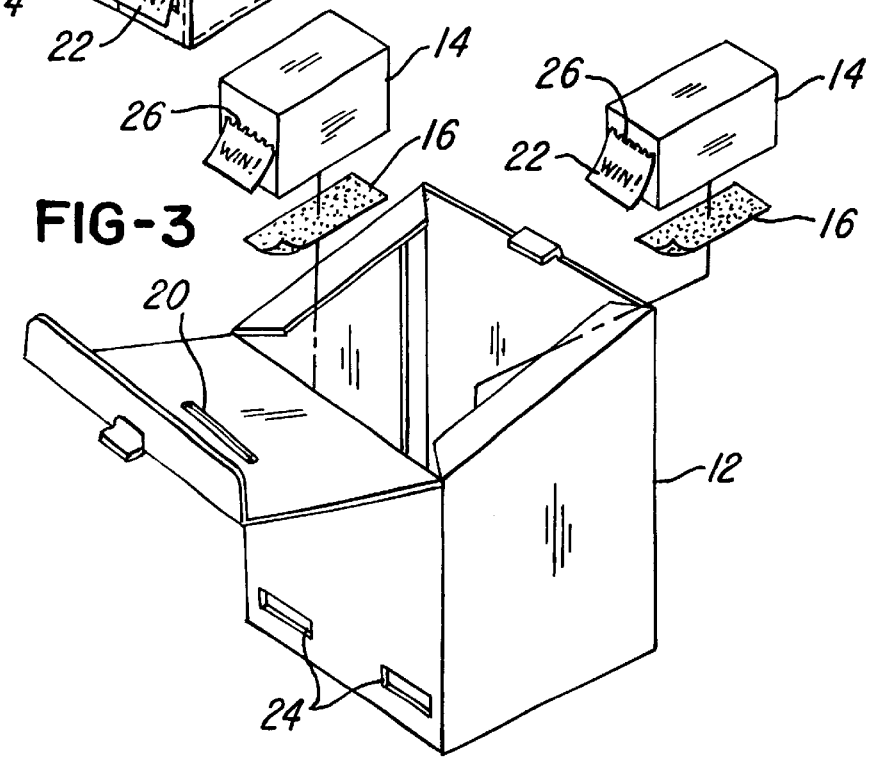
FIG. 3 is an exploded isometric view of the box of FIG. 1.

With reference to the drawings, a coupon dispensing and collection device in accordance with this invention is generally designated 10 and comprises an outer box 12 and two coupon dispensers 14 fastened to the inside bottom wall of the outer box 12 by means of double-sided adhesive sheets 16. The coupon dispensers 14 can be the same as those shown in the Simpson '699 patent or as those shown in the Emoff et al. '219 patent, but preferably without the parts used to mount the dispenser on a rack, shelf or the like.

The outer box 12 has a coupon-deposit slot 20 for depositing individual coupons 22 into the box 12, and a pair of coupon-dispensing slots 24 aligned with coupon-exit slots 26 in the front walls of the coupon dispensers 14. As is apparent, one can remove a coupon 22 from either one of the dispensers 14 through a coupon-dispensing slot 24, fill in the coupon 22, and deposit the coupon into the box 12 by dropping it through the coupon-deposit slot 20.

It will be recognized that there could by only one, or else more than two, coupon dispensers 14 in the outer box 12, and that means other than the double-sided adhesive sheets 16 could be used to secure the coupon dispensers 14 in the outer box 12. Also, the actual locations of the slots 20 and 24 could be different from those shown in the drawings.

Dispensers of the type shown in the Emoff et al. '219 patent and the Simpson '699 patent have a stack of coupons constructed such that the removal by a person of a top coupon through an opening in the dispenser housing causes the next coupon to be exposed in the housing for subsequent removal. However, this invention is not dependent on the type of coupon dispenser that may be used and coupon dispensers operating on entirely different principles could be used. As one example of many possibilities, dispensers (not shown) which have mechanical means for severing individual sheets from a roll or a stack of coupons and exposing the severed sheet to an opening 24 in an outer box 12 could be used.

Although the presently preferred embodiments of this invention have been described, it will be understood that within the purview of the invention various changes may be made within the scope of the following claims.

Having thus described my invention, I claim:

1. A coupon dispensing and containing device comprising:

an outer box having a coupon-dispensing opening and a coupon depositing opening; and an inner box affixed in said outer box, said inner box containing coupons and having a coupon-exit opening aligned with said coupon-dispensing opening.

2. The device of claim 1 wherein said coupon dispensing opening is in a front wall of said outer box and said coupon depositing opening is in a top wall of said outer box.

3. The device of claim 1 wherein said outer box has at least two coupon-dispensing openings and wherein there are at least two inner boxes affixed within said outer box, each of said inner boxes each containing coupons and each having a coupon-exit opening aligned with one of said coupon-dispensing openings.

4. The device of claim 3 wherein said coupon dispensing openings are in a front wall of said outer box and said coupon depositing opening is in a top wall of said outer box.

* * * * *